US007301534B2

(12) United States Patent
Runolinna

(10) Patent No.: US 7,301,534 B2
(45) Date of Patent: Nov. 27, 2007

(54) DETERMINING THE LIGHTING CONDITIONS SURROUNDING A DEVICE

(75) Inventor: Mika Runolinna, Helsinki (FI)

(73) Assignee: Nokia Corporation, Espoo (FI)

( * ) Notice: Subject to any disclaimer, the term of this patent is extended or adjusted under 35 U.S.C. 154(b) by 728 days.

(21) Appl. No.: 10/445,278

(22) Filed: May 23, 2003

(65) Prior Publication Data

US 2004/0036820 A1 Feb. 26, 2004

(30) Foreign Application Priority Data

May 23, 2002 (EP) ..... 02011308

(51) Int. Cl.
*G09G 3/36* (2006.01)
*G09G 5/00* (2006.01)

(52) U.S. Cl. ..... 345/207; 345/102; 345/104

(58) Field of Classification Search ..... 345/55–109, 345/204–207, 590
See application file for complete search history.

(56) References Cited

U.S. PATENT DOCUMENTS 5,406,305 A * 4/1995 Shimomura et al. ..... 345/102
5,818,553 A * 10/1998 Koenck et al. ..... 345/102
5,850,205 A * 12/1998 Blouin ..... 345/102
6,094,185 A 7/2000 Shirriff
6,144,359 A * 11/2000 Grave ..... 345/102
6,529,212 B2 * 3/2003 Miller et al. ..... 345/102
6,624,756 B1 * 9/2003 Butterworth ..... 345/101
6,762,741 B2 * 7/2004 Weindorf ..... 345/102
6,870,567 B2 * 3/2005 Funston et al. ..... 345/590
2001/0007470 A1 7/2001 Haavisto
2001/0008395 A1 7/2001 Yamamoto et al.
2001/0050757 A1 12/2001 Yoshida et al.
2003/0214242 A1 * 11/2003 Berg-johansen ..... 315/169.3
2005/0184983 A1 * 8/2005 Brabander et al. ..... 345/204

* cited by examiner

*Primary Examiner*—David L. Lewis
(74) *Attorney, Agent, or Firm*—Alfred A. Fressola; Ware, Fressola, Van Der Sluys & Adolphson LLP

(57) ABSTRACT

The invention relates to a method for determining the lighting conditions surrounding a device comprising a transmissive color LCD display 1. In order to obtain a detailed information on the lighting conditions, it is proposed that the method comprises measuring within the device the intensity of light passing through the LCD display 1 from outside of the device, while no backlight is switched on. The light is color filtered by at least part of the LCD display 1 with a known color distribution. The invention equally relates to a device comprising means for carrying out the proposed method.

37 Claims, 1 Drawing Sheet

DETERMINING THE LIGHTING CONDITIONS SURROUNDING A DEVICE

CROSS REFERENCE TO RELATED APPLICATIONS

The present application claims priority under 35 USC §119 to European Patent Application No. EP 02 011 308.0 filed on May 23, 2002.

FIELD OF THE INVENTION

The invention relates to a method for determining the lighting conditions surrounding a device comprising a transmissive color LCD (liquid crystal display). The invention relates equally to a device comprising a transmissive LCD color display.

BACKGROUND OF THE INVENTION

It is well known in the state of the art to supply a device, e.g. a mobile terminal, with a color LCD display, which allows presentation of information in color to a user of the terminal.

A color LCD display comprises different pixels, each of which can be set to be white, red, green and/or blue. The distribution of the colors to the different pixels of the display is selected according to the information that is currently to be presented. In addition, the brightness of each color can be set for each presented pixel. A user of the device will be able to see the information on the display due to reflective characteristics of the display.

In case the LCD display is moreover transmissive, the set pixels can constitute in addition a color filter for a backlight provided to the display from within the device. The filtered light is perceived by a user of the device equally as information presented on the display. The backlight may improve the presentation in particular in unfavorable light conditions.

Usually, there is not much information available on the characteristics of LCD displays released by different manufacturers. Some displays may turn out to perform well under specific light conditions, but poorly under other light conditions.

But even the presentation on displays of a high quality might be difficult to perceive in extreme lighting situations. Such extreme lighting situations can be for instance bright daylight, very blue light, or certain hues typical for each location on earth. The performance of the display is given by the sum of the adaptation state of the user, the reflection of external light on the display panel, and the characteristics of the display itself.

It is known to use sensors which measure the intensity of the light which is currently surrounding a device. Such measurements are for example used in CD-players, which adjusts the display light according to a measured light intensity. Such measurements are also used in mobile terminals, which automatically turn a backlight on, in case this is assumed to be required with the current intensity of surrounding light. These approaches, however, do not take into account the coloring of the respective surrounding light, which coloring may result in different effects on different colors of the display. Thus, these approaches do not provide an optimal adaptation of the presentation on a display to the respective lighting conditions.

Also functions of a device other than the presentation of information on the LCD display might be influenced by the specific coloring of the surrounding light. In case the device comprises a digital camera, for example, the quality of images taken by the camera might depend on the degree of an achieved adaptation of a calibration of the camera to the respective lighting conditions.

SUMMARY OF THE INVENTION

It is an object of the invention to provide detailed information on the lighting conditions surrounding a device.

These objects are reached on the one hand with a method for determining the lighting conditions surrounding a device comprising a transmissive color LCD, which method comprises measuring within the device the intensity of light passing through the display from outside of the terminal. The light of which the intensity is measured is color filtered by the LCD display with a known color distribution. During the measurements, no backlight is switched on within the device.

On the other hand, the objects are reached with a device comprising a transmissive LCD color display for presenting information to a user. It is proposed that the device further comprises a photometrical sensor placed within the device at a location to which light can penetrate from the outside of the device through the display. This photometrical sensor is suited to measure the intensity of light entering the device after having been color filtered by the display. It is moreover proposed that the device comprises processing means for adjusting the display to provide a known color filtering for measurements by the photometrical sensor.

The invention proceeds from the idea that the filtering function of a transmissive color LCD display of a device can be made use of for measuring the current coloring of the light surrounding the device. More specifically, a sensor within the device is used according to the invention for measuring the luminance of color filtered light entering the device through the display, while the display is set to known color distributions. In order to avoid a falsification of the luminance measurements, there should be no backlight on during the measurements. The measurements resulting with known color distributions in the display constitute an indication of the current local coloring of the light surrounding the device, which influences e.g. the perception of the presentation on the display.

It is an advantage of the invention that the measured light intensity of the color filtered light provides a detailed information on the current lighting conditions. Such an information can be employed in particular for adapting settings of the device which relate to a function that depends on the surrounding lighting conditions.

Since the color filtering function of the display is used for performing luminance measurements, no additional hardware is required for the color filtering of the measured light.

Preferred embodiments of the invention become apparent from the subclaims.

The measured light intensity of the color filtered light can be employed in particular as a basis for fine-tuning the settings of the display when presenting information to the user of the device. The invention thus enables an adaptation of color presentations to differing lighting conditions, and thereby an improved quality of presentations on the display. It allows in particular to obtain an optimum balance of colors and contrasts in a given environment at a given time. It helps in obtaining the best performance of a display in more lighting situations than before, e.g. for indoor and outdoor use of the device, but equally for many other different lighting conditions. It also enables to compensate for characteristics of a display that are only optimized for specific lighting conditions.

The measurement results can be employed as well for other settings of a device which relate to some function that depends on the surrounding lighting conditions. In case the device is a digital camera, comprises a digital camera or is connected to a digital camera, for instance, this camera can be calibrated according to the determined lighting conditions for taking images. A device comprising a digital camera can be e.g. a mobile phone with an LCD display. Even in case the camera is integrated to the opposite side of the device than the LCD display, some part of the light intensity measurement results might be usable for calibrating the camera.

The adjustment of the settings of the device can be carried out by processing means of the device.

The photometric sensor of the device according to the invention may be any luminance measuring device that can be integrated into the device. It can consist for instance of a light resistor connected to an analog to digital converter (ADC).

Alternatively, the sensor may be e.g. a light diode, which constitutes a simpler sensor. A light diode provides a binary output depending on the intensity of received light. The darkness, i.e. the partial transparency, of the LCD display can be manipulated within the range of an LCD display controller. The respectively selected darkness of the display then works as a respective threshold in the measuring light diode.

The light diode could also be combined with several resistors in order to enable different thresholds for each darkness of the LCD display and a logic to use the resistors one after another. When the darkness of a main color of the LCD display is varied, a similar kind of photometrical values can be obtained as with a light resistor by taking into account the current darkness of the LCD display and in addition the currently employed resistor value. Such an approach will result in reduced costs for the sensor compared to the light resistor with ADC.

It is, however, a characteristic of a light diode that it changes its state within a marginal area of luminance. The on/off information provided by the diode does therefore not represent a clear state. Thus, it might be necessary to process the signal provided by the light diode with a disturbance signal filter. There are several possibilities for realizing such a disturbance signal filter. In one possible embodiment, a counter in a measuring driver may count the on/off-states of the diode within a period, and the sum is compared with a given value. In another possible embodiment, a resistor can work as a simple threshold without processing the signal with software more than checking the state. When selecting an analog electronic solution for a disturbance signal filter, the required sensitivity should be taken into account.

In a further alternative, the photometric sensor of the device is realized by a CCD (charge coupled device) cell. CCD cells are known to be used for digital cameras, including digital video cameras, spectrometers, etc. In case the device comprises e.g. a digital camera, the CCD cell of this digital camera can advantageously be used in addition as the photometric sensor of the device.

Within the device, the selected sensor can be placed to any location which is reached by the light passing the LCD display.

In one preferred embodiment, the sensor is placed directly under the transmissive LCD display. In this case, only one small part of the display panel has to act as a color filter and thus as an active area for the proposed measurements. Alternatively, the sensor can be placed to a light penetrating location at some distance to the display, e.g. next to a backlight source. In this case, the whole display should be used as a color filter during the measurements for the fine tuning in order to obtain the most accurate results.

The sensor measures the intensity of light penetrating through the LCD display from the outside of the device to the inside of the device, in particular as the luminance of the light in lux. In order to be able to evaluate the measurements for the fine adjustment of the LCD display, at least the active area of the display is set to a known color distribution. The active area of the display can be turned for example consecutively fully to white, red, green, and blue. The luminance is then measured by the sensor for each setting with no backlight on.

Alternatively, the display can be turned consecutively to known combinations of RGB, which may lead to more accurate results. The darkness of the filter may be varied in addition to the color distribution, in order to obtain an even higher accuracy in the measurements. In either case, the photometrical measurements for each setting only have to be carried out for a very short time.

The evaluation of the measuring values provided by the sensor can be supported in particular by a device-based data table and/or by a network-based-location-aware service. Such a device-based data table may comprise in particular keyvalues corresponding to possible measurement results and associate to these keyvalues different settings in the device, e.g. settings for fine tuning the LCD display like predefined combinations of main color (RGB) variables. For fine-tuning the LCD display, the data table may also associate only a number of different gamma settings to different keyvalues, which gamma settings define the brightness of the RGB elements of each pixel of the LCD display. A network-based location-aware service might update for example a corresponding data table in the device for the respective location of the device with local default lighting characteristics.

The data table can be made use of in the device by some processing means. The processing means can compare the measurement results with the keyvalues in the data table, and load e.g. a corresponding predefined combination of main color (RGB) variables, or a corresponding set of gamma settings. The retrieved information can then be used by the processing means to fine adjust settings in the device, e.g. to fine adjust each color LCD display output by modifying the values used for setting the LCD display. The color balance can moreover be fine tuned with the counterlight effect.

The associations in the data table can be created by carrying out photometric measurements of the color LCD display outside of the device with an accurate photometer or spectrometer while the display is alternatingly fully turned to white, red, green, and blue in different surrounding light conditions. In particular with a spectrometer, a measurement can also be done in all spectrum areas simultaneously using different combinations of main colors as filters. The spectrum area is much more narrow with a simple sensor. The surrounding light and viewing angle are typical variables to measure the characteristics of a display panel. The measurement point should be in the direction of a users eye.

The actual fine tuning of a display according to the results of the measurements and calculations may be achieved by processing color parameters of the display content in a display memory. In case the primary colors of the display are controlled with an analog control signal, however, the RGB signal levels can also be tuned directly by an analog tuning unit, which unit may also take care of the proposed measurements and calculations. This enables a particularly simple control algorithm for the color balance and/or the white balance.

In a digital camera, usually a photometrical sensor is employed for measuring a reflection density and tonal values using the three primary colors. The output signals of the sensor should be adjusted such that a correct reproduction of the white color of an image is achieved. A digital camera can be calibrated for example by calculating this white balance by adapting a predetermined value stored in a memory for the adjustment in accordance with the results of the measurements and calculations.

The internal sensor does not have to be a precision instrument for measuring the intensity of light entering the device. In case the device is calibrated with an accurate device, the quality of the measurement results of a less accurate internal sensor may be sufficient for supporting the desired functionality. Once the characteristics of a display are determined, a driver employed for controlling the display can be written in a way that a certain balance of colors and contrast constitutes the default settings of the display.

The method according to the invention may be carried out automatically by the device itself or be initiated by the user of the device.

In particular in case the sensor is placed directly under the display, the method can be performed continuously in real-time by the device. To this end, the active area of the display forming the light filter for the light detected by the sensor is turned in a loop to all basic colors, to all desired colour combinations and/or to all desired brightness values. Such a mode is in particular useful, in case the LCD display has mostly good reflective characteristics. For the measurements, the backlight has to be switched off briefly. This does not lead to a significant disturbance of the user, however, since the backlight can be switched on and off very quickly. The response time of the LCD display to new settings is longer, but when the active area is restricted to a dot in the corner of the display, while the rest of the display is used for the desired presentations, these settings are almost invisible to the user of the device.

The method according to the invention could be initiated by a user of the device for instance by means of a software button provided for activating a backlight. When the user has the impression not to obtain the best performance out of the display of the device, he/she can press the backlight button. This will result in an advantageous embodiment of the invention on the one hand in checking whether the current luminance is sufficient for a display without backlight, and on the other hand in determining the color characteristics of the current daylight according to the present invention. Then, the display is fine tuned according to the determined color characteristics, and the backlight is switched on if required. Alternatively or in addition, some other settings of the device are fine tuned.

The invention can be employed in any device comprising a transmissive color LCD display, e.g. in a mobile phone.

The invention can also be combined for instance with an application which employs a blinking background light in order to optimize a video display performance on the LCD display. Such a combination will create an optimally performing multimedia presentation.

BRIEF DESCRIPTION OF THE FIGURES

Other objects and features of the present invention will become apparent from the following detailed description considered in conjunction with the accompanying drawing. The only

DETAILED DESCRIPTION OF THE INVENTION

Figure 1:
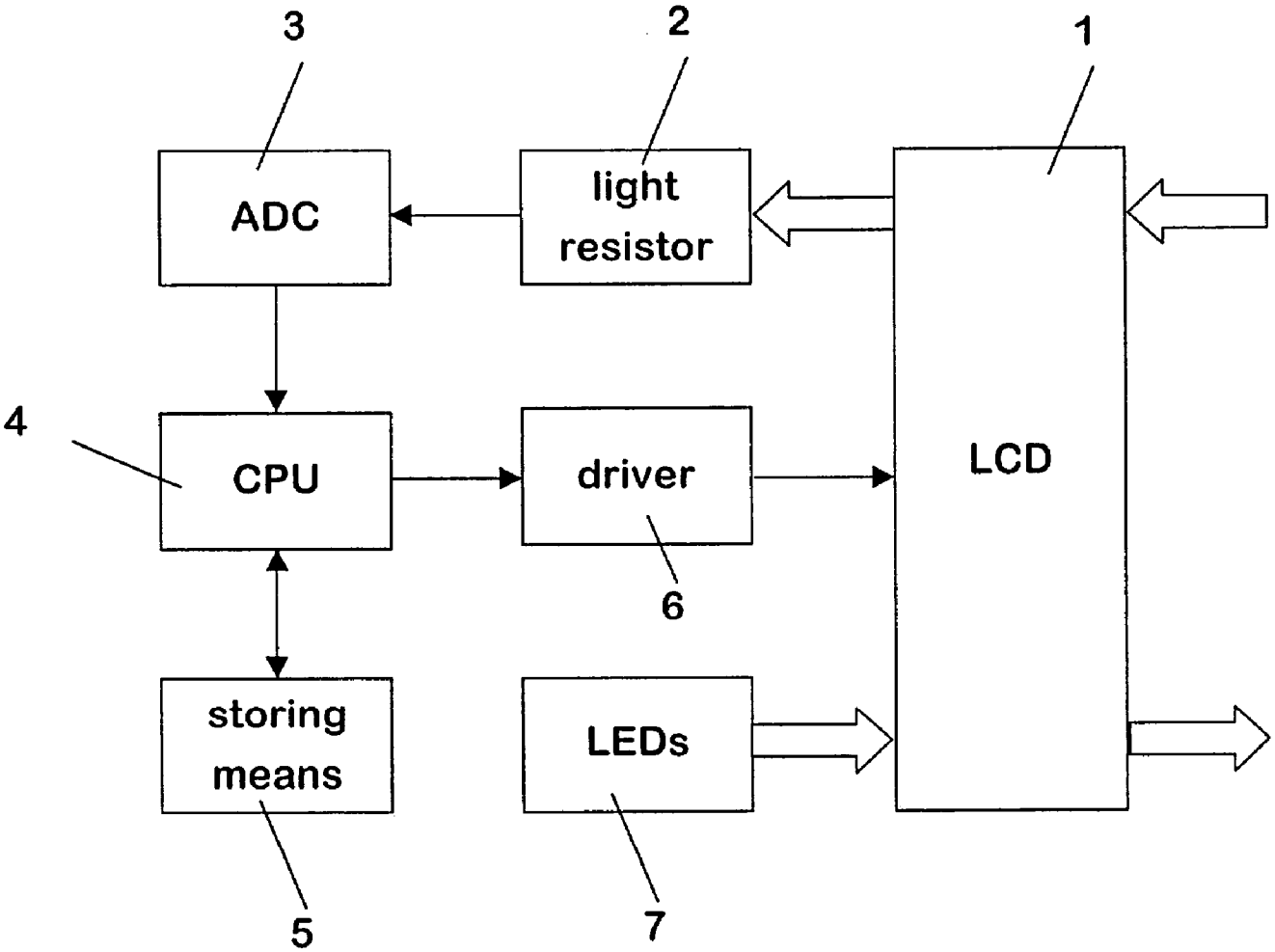
FIG. 1 shows a block diagram with components of a device according to the invention.

FIG. 1 shows components of a mobile terminal with a transmissive LCD color display 1, which can be fine-tuned according to the invention.

The transmissive LCD color display 1 is a known LCD color display, in which each pixel can be turned to white, red, green or blue. Equally, a combination of the three main colors RGB can be selected for each pixel. In addition, the brightness of each pixel can be varied for each color. The LCD display 1 has mainly good reflective characteristics.

The mobile terminal further comprises a light resistor 2 which is positioned immediately behind one of the corners of the LCD display 1. The light resistor 2 is able to measure the light intensity of light passing at the location at which the light resistor 2 is positioned through the LCD display 1 from the outside. The light resistor 2 is connected via an ADC 3 to a central processing unit (CPU) 4 of the mobile terminal.

The CPU 4 has access to storing means comprising a data table 5. This data table associates predefined combinations of main color (RGB) variables to a respective set of key-values. The data in the data table was created by measuring the display 1 with an accurate photometer or a spectrometer for different display settings and different lighting conditions.

The CPU 4 is further connected to an LCD driver 6. The LCD driver has a controlling access to the LCD display 1. The driver 6 is calibrated with a default setting for a fine tuning under average lighting conditions. Finally, LEDs 7 suited to provide a backlight are depicted. The LEDs 7 are arranged to this end behind the LCD display 1 within the mobile terminal.

Signals transmitted between the depicted blocks 1-7 are indicated by simple arrows, while light passing the LCD display 1 is indicated by broad arrows.

Now, the fine-tuning of the LCD display 1 according to the invention with the components of FIG. 1 will be described.

The setting of the pixels of the LCD display 1 is controlled by the CPU 4 via the LCD driver 6. For the fine-tuning, the pixels of the small portion of the LCD display 1 behind which the light resistor 2 is positioned are turned alternatingly completely to white, red, green and blue for a very short time. In addition, the brightness of the pixels in this portion of the LCD display 1 is varied. For the fine-tuning, thus only this small portion of the LCD display 1 constitutes an active area.

The light resistor 2, which constitutes together with the ADC 3 a light sensor, measures the intensity of the color filtered light passing from the outside to the inside of the mobile terminal through the mentioned active area of the LCD display 1. During these measurements, the backlight provided by the LEDs 7 is switched off. The analogue measurement results of the light resistor 2 are provided to the ADC 3. The ADC 3 converts the received analogue measurement results to digital measurement values and provides these to the CPU 4.

When the digital measurement values have been received for all of the different display settings, the CPU 4 compares the received measurement values with the keyvalues in the data table 5. The CPU 4 selects from the table the predefined combination of main color (RGB) variables associated in the table to those keyvalues corresponding to the received measurement values. The CPU 4 uses the determined variables for fine tuning the values which are required for setting all pixels of the LCD display 1 for a desired presentation. The fine tuned values are provided as coefficients to the LCD driver 6, which uses the received coefficients for controlling the LCD display 1, taking into account the default values.

As a result, the presentation of the information on the display is optimized for the current local lighting conditions. If required, the display can be supported by switching on a backlight by means of the LEDs 7.

The measurements are performed in this embodiment continuously during the normal operation of the mobile terminal. The active area in the LCD display 1 is controlled in a loop turning the filter to all basic colors and all desired brightness values. For each measurement, the backlight is briefly switched off. Since the active area appears only as a dot in a corner of the LCD display 1, also the setting of this active area to different colors and brightness values is almost invisible to the user.

It is to be noted that the described embodiment constitutes only one of a variety of possible embodiments of the invention.

The invention claimed is:

1. A method comprising:

measuring within a device comprising a transmissive color liquid crystal display for presenting information to a user, the intensity of light passing through said liquid crystal display from outside of said device, while no backlight is switched on, wherein said light is color filtered by at least part of said liquid crystal display with a known color distribution.

2. A method according to claim 1, wherein at least part of said liquid crystal display is alternatingly turned entirely to one of different colors for providing said color filtered light.

3. A method according to claim 1, wherein at least part of said liquid crystal display is turned to at least one known combination of different colors for providing said color filtered light.

4. A method according to claim 1, wherein the brightness of at least part of said liquid crystal display is additionally varied while measuring the intensity of said color filtered light.

5. A method according to claim 1, wherein basically only the intensity of light penetrating a selected part of said liquid crystal display is measured, and wherein only said selected part of said liquid crystal display is set to a known color distribution for said measurements.

6. A method according to claim 5, wherein only said selected part of said liquid crystal display is set to a known color distribution for said measurements.

7. A method according to claim 1, wherein basically the light penetrating the entire liquid crystal display is measured, and wherein basically the entire liquid crystal display is set to a known color distribution for said measurements.

8. A method according to claim 1, further comprising adjusting settings associated to a specific function of said device and/or to a specific function of a unit connected to said device, based on the measured light intensity of the color filtered light.

9. A method according to claim 8, wherein for adjusting said settings, said measured light intensity values are compared with stored keyvalues, each of said stored keyvalues being associated to predefined values for adjusting said settings.

10. A method according to claim 9, wherein said stored keyvalues and said predefined values are provided to said device by a network based service.

11. A method according to claim 8, wherein for adjusting said settings, said measured light intensity values are evaluated by a network based service providing values for adjusting said settings.

12. A method according to claim 8, wherein adjusting settings based on the measured light intensity of the color filtered light comprises adjusting settings for said liquid crystal display for each presentation.

13. A method according to claim 8, wherein adjusting settings based on the measured light intensity of the color filtered light comprises adjusting settings employed for calibrating a digital camera for an optimized taking of images, which digital camera constitutes said device, is integrated into said device or is connected to said device.

14. A method according to claim 1, wherein said method is performed automatically by said device.

15. A method according to claim 1, wherein said method is performed continuously during the operation of said device.

16. A method according to claim 1, wherein said method can be initiated by a user of said device.

17. A device comprising:

a transmissive color liquid crystal display for presenting information to a user;

a photometrical sensor placed within said device at a location to which light can penetrate from the outside of said device through said liquid crystal display, which photometrical sensor measures the intensity of light entering said device which was color filtered by said liquid crystal display; and a processor for adjusting said liquid crystal display to provide a known color filtering for measurements by said photometrical sensor.

18. A device according to claim 17, wherein said photometrical sensor comprises a light resistor for measuring the intensity of received light and for outputting corresponding analogue measurement values, and an analogue-to-digital converter for converting analogue measurement values output by said light resistor into digital measurement values.

19. A device according to claim 17, wherein said photometrical sensor comprises a light diode outputting a binary value.

20. A device according to claim 19, wherein said photometrical sensor comprises in addition at least two resistors for enabling different threshold values for said light diode.

21. A device according to claim 17, wherein said photometrical sensor comprises a charge coupled device cell.

22. A device according to claim 21 comprising a digital camera, wherein said charge coupled device cell is used in addition by said digital camera for taking images.

23. A device according to claim 17, wherein said photometrical sensor is placed close to said liquid crystal display such that said photometrical sensor basically measures only light penetrating a selected part of said liquid crystal display.

24. A device according to claim 23, wherein said processor adjusts only said selected part of said liquid crystal display to provide a known color filtering for measurements by said photometrical sensor.

25. A device according to claim 17, wherein said photometrical sensor is placed at a distance to said liquid crystal display such that said photometrical sensor basically measures the light penetrating the entire liquid crystal display.

26. A device according to claim 17, wherein for measurements of the intensity of color filtered light by said photometrical sensor, said processor turns at least part of said liquid crystal display alternatingly entirely to one of different colors.

27. A device according to claim 17, wherein for measurements of the intensity of color filtered light by said photometrical sensor, said processor turns at least part of said liquid crystal display to at least one known combination of different colors.

28. A device according to claim 17, wherein during said measurements by said photometrical sensor, said processor additionally varies the brightness of at least part of said liquid crystal display.

29. A device according to claim 17, wherein said processor further adjusts settings associated to specific functional means of said device and/or to specific functional means of a unit connected to said device, based on measurements by said photometrical sensor.

30. A device according to claim 29, further comprising a data table for storing keyvalues corresponding to possible measurement values provided by said photometrical sensor, and for storing predetermined values for adjusting said settings, which predetermined values are associated to respective ones of said keyvalues, wherein said processor is able to access said data table.

31. A device according to claim 30, wherein said device can be connected to a network, said processor further for updating said values stored in said data table based on data received from a network to which said device is connected.

32. A device according to claim 17, wherein said processor further adjusts settings for said liquid crystal display for each presentation of information.

33. A device according to claim 17 comprising a digital camera, wherein said processor further adjusts settings employed for a calibration of said digital camera for optimizing the taking of images.

34. A device according to claim 17, wherein said processor automatically adjusts said liquid crystal display to provide a known color filtering for measurements by said photometrical sensor and evaluate received measurement values from said photometrical sensor.

35. A device according to claim 17, further comprising a user input for enabling a user to cause said processor to adjust said liquid crystal display to provide a known color filtering for measurements by said photometrical sensor and to evaluate received measurement values from said photometrical sensor.

36. A device comprising:

means for presenting color display information to a user;

photometrical means placed within said device at a location to which light can penetrate from the outside of said device through said means for presenting color display information to a user, which photometrical means are measuring the intensity of light entering said device which is color filtered by said means for presenting color display information to a user; and means for adjusting said means for presenting color display information to a user to provide a known color filtering for measurements by said photometrical means.

37. A device according to claim 36, wherein said photometrical means comprises a light resistor for measuring the intensity of received light and for outputting corresponding analogue measurement values, and an analogue-to-digital converter for converting analogue measurement values output by said light resistor into digital measurement values.

* * * * *